US006296580B1

(12) United States Patent
Hamet

(10) Patent No.: US 6,296,580 B1
(45) Date of Patent: Oct. 2, 2001

(54) ADAPTABLE PLAYING FIELDS WITH VENTILATED STRUCTURES

(76) Inventor: Laurent Hamet, 12 allées des Soupirs, 31000 - Toulouse (FR)

( * ) Notice: Subject to any disclaimer, the term of this patent is extended or adjusted under 35 U.S.C. 154(b) by 0 days.

(21) Appl. No.: 09/413,857

(22) Filed: Oct. 7, 1999

(30) Foreign Application Priority Data

Jun. 8, 1999 (FR) ..... 99 07184

(51) Int. Cl.[7] ..... A63B 67/00

(52) U.S. Cl. ..... 473/415; 52/2.11; 52/2.23; 273/349; 472/92

(58) Field of Search ..... 473/415; 273/350, 273/349; 472/62, 92, 134, 128, 93, 94; 135/116, 126, 137; 52/2, 11, 2.17, 2.18, 2.25; 416/186 R, 187, 181, 185

(56) References Cited

U.S. PATENT DOCUMENTS

| | | | | |
|---|---|---|---|---|
| 5,462,505 | * | 10/1995 | Blair et al. | 472/134 |
| 5,636,478 | | 6/1997 | Chen . | |
| 5,720,678 | | 2/1998 | Korthauer . | |
| 5,906,373 | | 5/1999 | Sanders . | |
| 5,937,586 | * | 8/1999 | Scherba | 52/2.11 |

* cited by examiner

*Primary Examiner*—Jeanette Chapman
*Assistant Examiner*—Mitra Aryanpour
(74) *Attorney, Agent, or Firm*—Crowell & Moring, L.L.P.

(57) ABSTRACT

Paint-ball playing fields are characterized by empty envelope elements fastened together creating a continuous interior volume filled with air, under a predetermined pressure of approximately 1.5 bars. A motor furnishes air to compensate for losses of pressure in the elements of the field.

10 Claims, 4 Drawing Sheets

ADAPTABLE PLAYING FIELDS WITH VENTILATED STRUCTURES

BACKGROUND AND SUMMARY OF THE INVENTION

This application claims the priority of French Application No. 9907184, filed June 8, 1999, the disclosure of which is expressly incorporated by reference herein.

The invention is in the scope of sport equipment. It involves the creation of an adaptable playing field intended for the sporting game known as "paint-ball".

The game known as paint-ball (a term used in the following description) is a team sport. The goal of each team is to seize the opponent team's flag, and to return it back into their base, without getting eliminated. A player is eliminated from the game as soon as he is marked by a paint ball impact, on his clothes or on his equipment (marker, harness). The game finishes when a player raises the opponents flag on his own base, or when time runs out.

Today's paint-ball fields are typically roughly rectangular in shape and cover several hundred square meters, (the total surface can vary according to criteria such as the number of players, etc.) and they include a certain number of obstacles (natural and/or man-made), which provide the players with cover and hideouts.

These fields are permanently installed and usually take advantage of the existing natural scenery. In this respect, fields rarely look alike, are very often totally dissymetrical for two teams, and fail to provide spectators with a place where they can comfortably sit and visualize the game.

Currently, paint-ball obstacles exist in the form of inflatable structures, marketed by the assignee of the present invention. The obstacles are inflated at the beginning of a game and placed strategically in previously chosen positions. The main inconvenience of these obstacles is their weight, in order to be airtight, thick material like tarpaulin is necessary, with welded or vulcanized seams between the different obstacles. The obstacles as a whole are therefore heavy and expensive. It is equally quite difficult for field operators to repair the structures locally.

The goal of the present invention is to remedy the precedent inconveniences.

The goal of the invention is therefore to propose a new paint-ball field concept that can be assembled, dismantled and transported, whose limits are determined by the object mechanism of the invention.

Another advantage of these fields is that they can be installed rapidly.

Thirdly, the field can be chosen from a large number of possible combinations of the ventilated structures, and can offer both teams symmetrical game surfaces.

Fourth, the invention makes the game safer by eliminating the presence of rigid obstacles.

Fifth, the equipment is very easy to maintain.

According to the present invention, paint-ball playing fields are characterized by empty envelope elements fastened together to create a continuous interior volume filled with air, under a predetermined pressure, and a means to compensate for any loss of pressure.

By using ventilated structures, one is able to assemble an identical field in different places where games have to be played, and to transport the field from one place to another.

Additionally, the choice of ventilated structures as opposed to inflatable structures reduces the need for thick airtight material, and therefore contributes to a greater economy in the production of the fields, and a reduction of the overall weight of the playing field.

By installing the field on a clear surface, it now becomes easy to allow spectators to watch the game and follow and compare games. The media will also be able to move freely around the playing fields, which will be installed to this advantage.

Ideally, the elements will have obturable air supply shafts running along at least one of their sides, and at one of their extremities.

This layout will favor a standardization of the connections between the shafts and the obstacles, and will facilitate the installation of the fields. Additionally, the presence of multiple means to supply air, on at least one side of the shafts, guaranties the organizers greater flexibility upon installing the fields.

On an ideal installation base, the elements will include:

large shafts which determine the playing field's limits;

small shafts adapted to be perpendicularly fixed to the large shafts on their obturable air supplying means;

extensions adapted to be perpendicularly fixed to the small shafts on their obturable air supplying means; and obstacles adapted to be fixed to the ends of the extensions or directly to the small shafts.

The elements will also advantageously include connections to link the large shafts and the small shafts, simple angle elements, and at least one motorized angle element.

It is understood that on one hand a playing field that is simple to assemble is necessary, while on the other hand, a large degree of creativity is provided. The creation of great variety of additional obstacles will be possible as long as they remain conforming to the connections, air supply means and standard elements.

In order to facilitate the transport and assembly of the playing fields, the elements are produced in porous textile which varies in weight from 50 to 200 grams per $m^2$.

The elements are made out of predetermined shapes of material stitched together, and are adapted to a particularly intensive use on the playing field.

In order to solve the problem of excessive wear by internal air pressure and player contact, the connections between the elements include a double looped spiral zip.

In order to minimize the field's cost and to facilitate changing key elements, the means to compensate the loss of pressure in the interior volume is a centrifugal ventilator whose output is between 0 and ½ $m^3$ per second, and adapted to maintain a pressure of approximately 1.5 bars at all times in the interior volume.

Other objects, advantages and novel features of the present invention will become apparent from the following detailed description of the invention when considered in conjunction with the accompanying drawings.

DETAILED DESCRIPTION OF THE DRAWINGS

Figure 1:
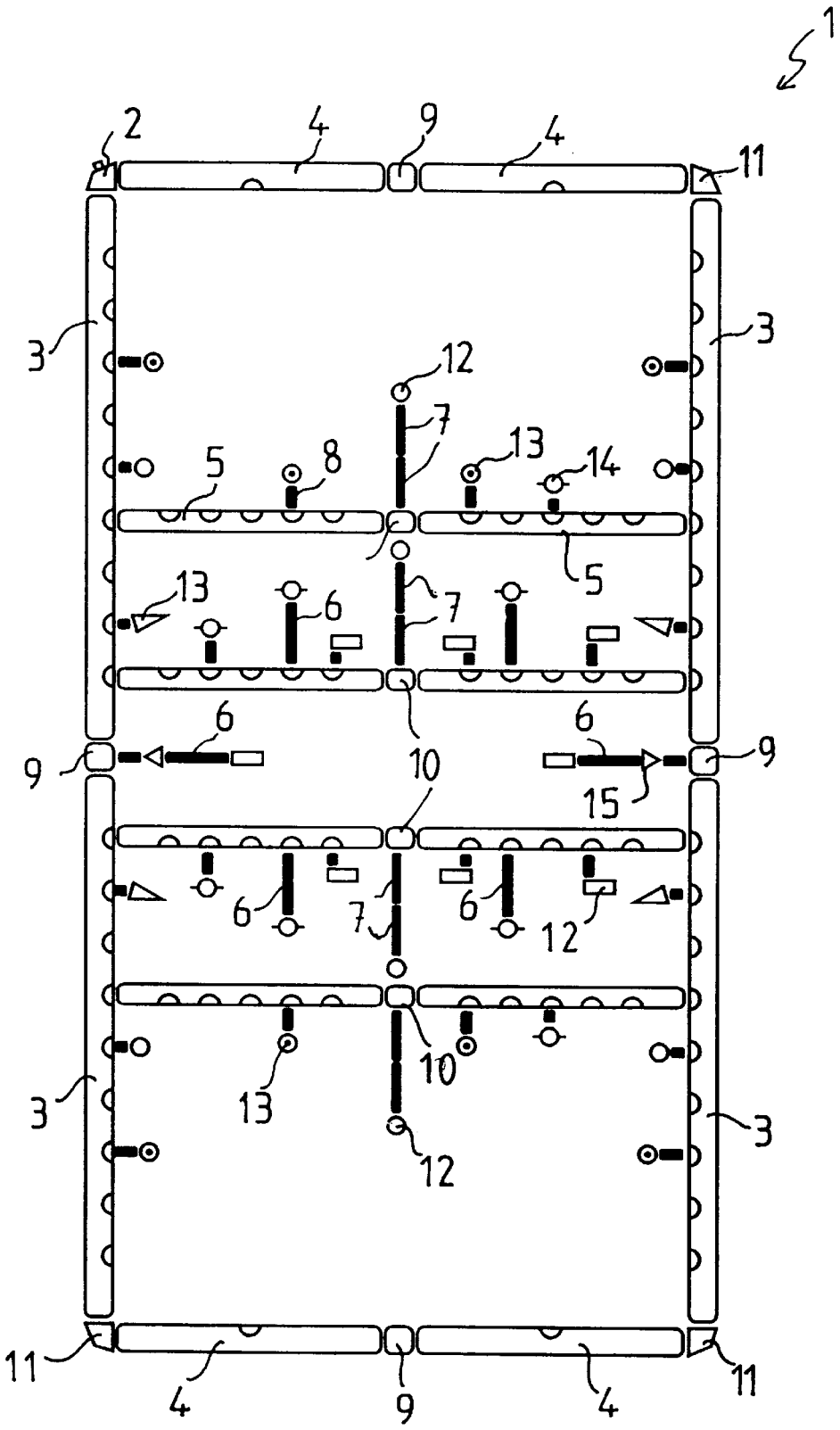
FIG. 1 represents the plan of a playing field according to the invention.

As we can see from FIG. 1, a playing field 1 conforming to the invention includes a certain number of juxtaposed elements lined up continuously on an approximately rectangular surface (but which, as we can easily contemplate, could also have been chosen in a different shape).

The elements take the form of empty textile elements fastened together to create an interior volume filled with air, which is permanently ventilated (to compensate any loss of air through the seams, porosity etc.), where the envelope surface tension determines the geometrical shape.

A field such as field 1 includes therefore a ventilation element 2, to maintain all of the field elements under air pressure (roughly 1.5 bars), shaft elements 3,4,5,6,7,8, which are principally cylindrical, and whose length and diameter vary according to use, connection elements 9,10 and 11 which connect the shafts lengthways or in corners, and differently shaped obstacles 12,13,14 and 15, which can be arranged vertically or horizontally.

In the non-limiting field example that we have described here, the playing field 1 includes:

1) To define the rectangular exterior limits of the playing field 1:

an angle motor 2 (ventilation source);

four longer large lateral shafts 3 (length 50 m in this example);

four shorter large lateral shafts 4 (length 24 m);

four connecting elements 9; and three simple angle elements 11.

These elements are assembled end to end to form a rectangle of 100 m by 48 m.

2) To define the intermediary limits and the obstacle's air supply sources:

eight small transversal shafts 5 (length 24 m), fastened by an extremity to a side (cylindrical) of the small shafts; and four transversal connection elements 10, connecting between them two extremities of the small shafts.

3) To position and furnish the obstacles with air:

six long extensions 6 (length 6 m);

eight middle-sized extensions 7 (length 2 m);

fourteen short extensions 8 (length Im); and fourteen direct links 16 from the obstacles to the small shafts 5.

4) The obstacles can include:

eight vertical cones 13;

four horizontal cones 13;

fifteen vertical cylinders 12;

eight horizontal cylinders 12;

two pyramids 15; and eight "rocket" obstacles 14.

Each of these obstacles is linked to an extension which positions it and furnishes it with compressed air.

Such a field is about 100 m long by 48 m wide. Many combinations are possible with these elements, which is an advantage over the traditional sedentary paint-ball fields.

As can be seen, this invented playing field uses two types of shafts. The large ones 3, 4 have 16 centimeter diameters and are used because they have a superior air debit for a better overall air supply in the whole field.

They also play the role of delimiting the playing surface. The small shafts 5, of 11 centimeter diameters are used to feed air to the obstacles, and because they obstruct the game to a lesser degree.

We can also grasp that other extending elements can also be produced, for example large shafts of 5 m, 8 m, 20 m, small 8 m shafts etc.

All the elements have an envelope made of flexible material like nylon polyester with a layer of polyurethane on the surface (to reduce air porosity), similar to anorak material. The thickness of the material is chosen from a scale ranging from 50 to 200 g/m$^2$.

The choice of such a thin and flexible material is a determinant factor in the speed of packing the playing field, and in the transportation weight.

An obstacle which is typically made from 6 to 8 m$^2$ of material which weighs 180g/m$^2$ will weigh 1 or 2 kg, taking into account the seams and fixation reinforcements, and will be two to four times lighter than a truck tarpaulin. A field such as the one we have described above, including roughly 40 obstacles, plus the air supply shafts, will weigh in total less than 150 kg, and therefore be transportable in a car.

A light material is also considerably easier to clean than a thick plastic tarpaulin type of material.

The elements are therefore constituted of pieces of material cut according to the desired finished shape, and sewn together.

Figure 2:
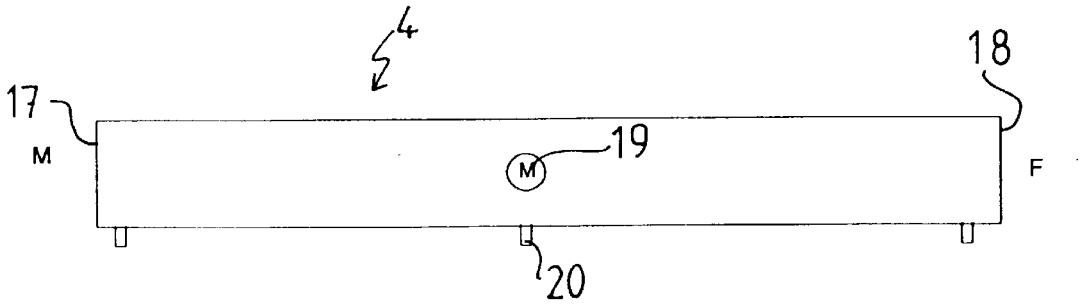
FIG. 2 represents a side view of a shaft.

A large shaft 4 to 24 meters long is illustrated (shown face on) in FIG. 2. It appears in the form of a long cylinder, having on one end a male connection 17 (obturable opening), on the other end a female connection 18 (a female connection is half zip with a female end and a pulling device, and a male connection is half a zip with a nozzle adapted to interlock with the female connection), a series of lateral male connections 19 on at least one of the sides every five meters, and fixation keepers 20 regularly spaced on the ground.

The long 3, or short 4, large lateral shafts, and the linking elements 9 are made on this same model.

Figure 10:
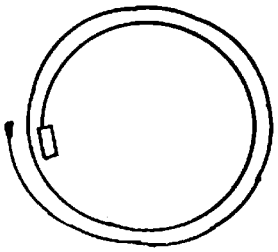
FIG. 10 illustrates a way of fixing the elements together by a double fixing turn.

Each female or male air supply connection is a zip, in the form of a double parallel looped spiral (FIG. 10) which corresponds to the size of the diameter or extension to which it links up.

The thin band of material has half a zip on one of its sides and is wound around itself according to the connection's diameter and the desired number of spirals, then sewn in the middle, forming several layers of female zips, arranged tightly side by side, with a nozzle in the middle of the spiral.

When the male connection and the female connection are put into correspondence, the nozzle of the male connection is inserted into the female connection, and the pulling device is slid along the twisted spiral from one end to the other.

A connection is obturated by a piece of material (provided with a complementary connection) when it is not being used for linking up another element. The double looped spiral connection is used to diminish the efforts created by traction around the link (for example throughout a game) on the junction of two elements or simply by injected air pressure.

Figure 3:
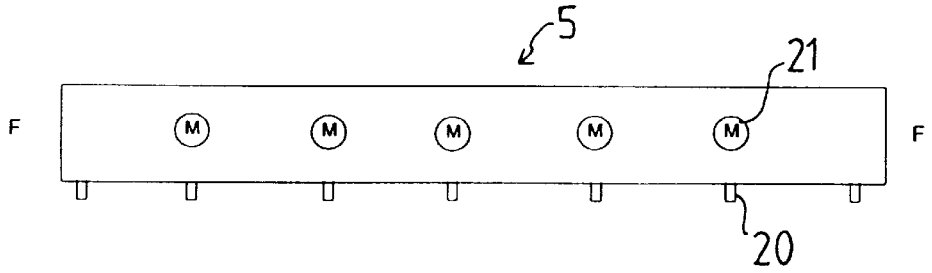
FIG. 3 represents a small shaft seen from the side.

In the same way, FIG. 3 illustrates a small shaft 5, whose ends are both female, and is dotted with five male connections 21 on one side, regularly spaced at four meter intervals, to connect the extensions 6,7,8,16 which position the obstacles. This small shaft 5 is dotted with seven ground anchoring device.

The non-used connections on the shafts 3,4,5 are closed by pieces of the same material that the shafts are made out of.

Figure 4:
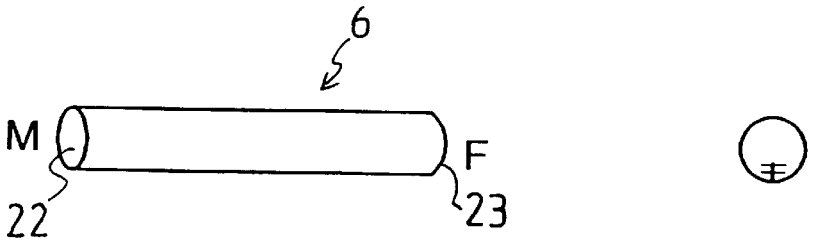
FIG. 4 represents an extension seen from the side and the front.

FIG. 4 shows an extension which is an 11 cm diameter cylindrical tube for 1.2 or 6 meters in length, with links on each end, one male 22 for fixing onto an obstacle, the other female 23, for fixing onto a lateral link 21 of a small shaft.

Figure 5:
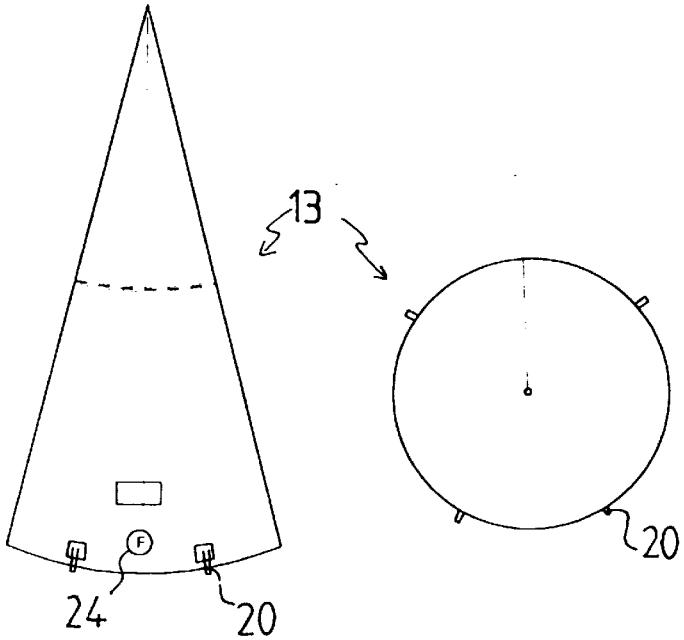
FIG. 5 represents a cone-like object seen from the side and from above.

As FIG. 5 shows, a conical obstacle 13, whose height in the present example is 3 meters, for a 1.5 diameter base, is provided with a female air supply link 24, and four ground fixation keepers, fixed at the base of the cone, or potentially equally near the tip of the cone 13, which can therefore be laid horizontally.

Figure 6:
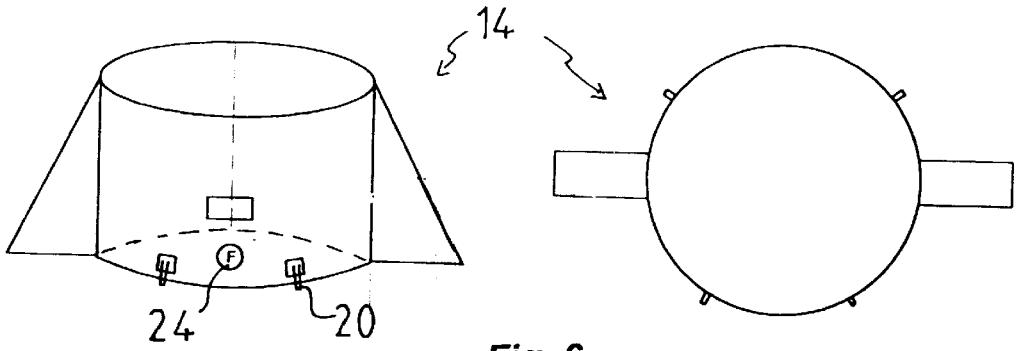
FIG. 6 represents a "rocket" type of obstacle seen from the side and from above.
Figure 7:
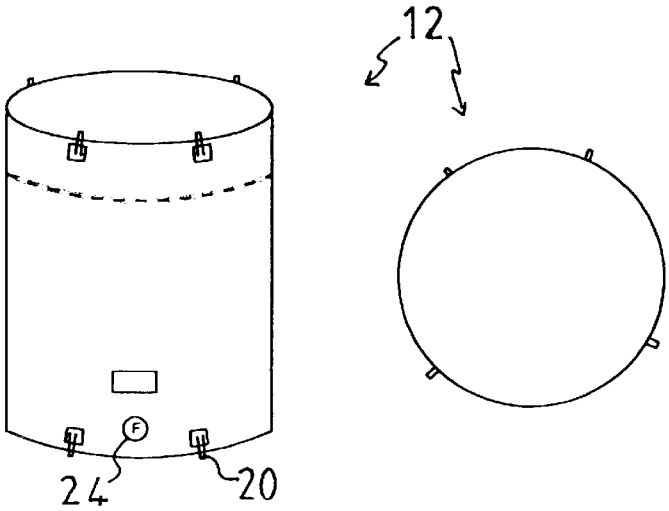
FIG. 7 represents a cylindrical type of obstacle seen from the side and from above.

FIGS. 6 and 7 show a "rocket" 14 type of obstacle or cylinder 12.

The ground fixation anchors 20 allow elements to be fixed by metallic (or rigid plastic) plugs such as tent hooks when you want to fix it on loose soil, or by ballast bags tied to the anchors 20 when the playing field 1 is installed on a hard surface such as a gymnasium.

Figure 8:
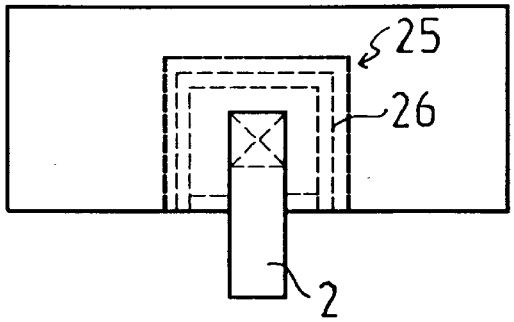
FIG. 8 represents a reinforcement object intended for anchoring fixing elements to the ground by tent-like hooks.

These keepers are made out of nylon girths and are generally assembled ten centimeters from the beginning of the shafts or extensions, underneath the potential air supply points. The keepers 20 are sewn on to the different elements and fixed for example by a square reinforcement tarpaulin 25 sewn twice over behind the material 26 (FIG. 8) to reduce any ripping due to strong traction (for example during a game).

In the same fashion, the obstacles include keepers 27 for fixing banners (not represented here). These keepers do not have tarpaulin reinforcements, because the traction on these elements is very weak (no traction foreseen on the banners).

The playing field uses three type of connection in the assembling of the elements (shafts, extensions, obstacles) according to the clients use of the product.

Figure 9A:
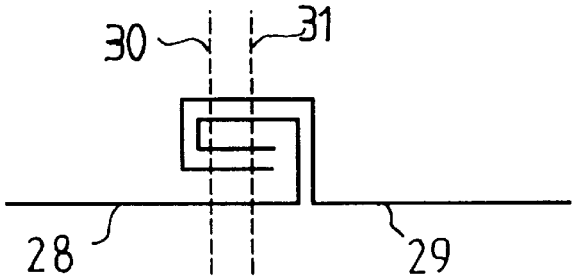
FIGS. 9A to 9C illustrate various sewing methods.

In the case of an intensive professional use, where it is necessary to mantle and dismantle often, a particularly sturdy stitch is employed. FIG. 9A shows a sketch of such a stitch. Both parts 28,29 of the material are folded over together twice, then a double stitch 30,31 is carried out through this double fold.

Figure 9B:
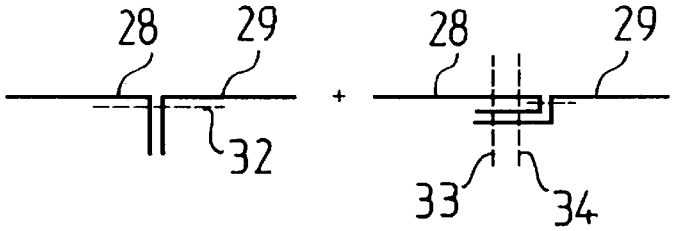
Figure 9C:
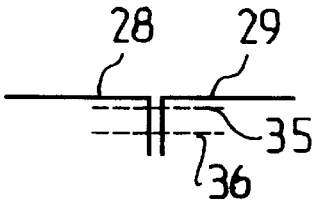

There is a first variation of this making, for example when the playing field is going to have a moderate use and will be more or less sedentary as in the case of a club, the parts 28, 29 are assembled by a stitch 32 described in detail in 33, 34 (FIG. 9B).

A second variation for an even more moderate use of the field, has parts 28 and 29 assembled by a double needled stitch described in 35, 36.

In the non-limiting example described here, a silliconed "electrobonded" type of nylon polyester thread with a low Teflon content is used, such as is marketed by Barbour and Cousin.

The angle motor 2 (ventilation source of the field) uses an electrical type of blowing ventilator (alternative 110–230 V for example) which is centrifugal and of roughly 250 Watts maximal power, adjustable by the user (0 to 100% in the present example), with a stabilized air debit (The playing field is under an over-all pressure of 0.5 bars, and the motor is used simply to compensate air loss through the seams, zips and material-porosity) of around $\frac{1}{10}$ $m^3$ per-second (this amount depends on the temperature, the pressure, etc.) which empty would be roughly ½ $m^3$ per second.

The assemblage of the field is as follows.

The blower (the angle motor ventilator 2) is linked to a collar of the angle motor.

The large shafts 3, 4 are unrolled on the ground to begin with, and arranged approximately in their final positions. The shafts 3, 4 are disposed with the links 19 oriented towards the middle of the field, and the seams facing the ground.

The shafts are then assembled end to end with the linking elements 9, the simple angles 11 and the angle motor. The assembling takes place by putting the links face to face and zipping the fixation zips.

Then the small shafts 5 are fixed by one end (the one with a female link) on to the lateral male links 19 of the large shafts 3, 4 perpendicularly according to the predetermined field plan The short shafts 5 are linked together using transversal linking elements 10 (to two male links).

By this stage, the field forms a connected closed volume.

It can be filled with air by starting up the ventilation motor. It fills up in about ten seconds (at the speed of roughly ½ $m^3$ per second), and then the field remains In the same shape as long as air is injected by the supply motor.

As soon as the field formed by these shafts is inflated, its almost rectangular shape can be verified, and the ground metallic fixation plugs can be installed on the anchors 20 when fixing upon loose ground.

To fix on to a hard surface (for example a car park or gymnasium) the same anchors 20 are used, and girths are threaded through these and tied to 10 to 15 kilo sand bags.

Extensions 6, 7, 8 are then installed perpendicularly in the same manner on some of the male links 21 of the small shafts 5. The obstacles are finally installed on the ends of the extensions 6,7, 8 or directly linked to the male links 21 on the small shafts 5, or large shafts 3, 4. The obstacles and the extensions 6, 7, 8 are fixed to the ground by the keepers and the fixation plugs. The field is then ready to be used.

Choice of motor is determined by the field volume which it will furnish with air, by the desired pressure of the obstacles and by the kind of material that they are made out of (more or less porous). A field made out of tarpaulin will need a much more powerful motor to counterbalance the weight of material being lifted when put under pressure.

It is clear that a certain amount of air loss in the elements constituting the field is necessary to this invention. Totally non-porous materials, as well as soldered seams are excluded.

We are not trying to achieve an air-proof inflatable playing field (balloon), but to achieve a simple, cheap, easily produced and assembled, therefore porous, field, and to take into account this porosity by compensating losses by a permanent air injection.

The air pressure conditions the rigidity of the obstacles. We have noticed that with an internal air pressure of approximately 15 bars, the obstacles are not deformed by wind or by the players contact.

The advantages of the invention of these paint-ball playing fields are multiple.

The delimitation of the field by geometrical elements means that the field's perimeter is more precise than the pre-existing natural playing fields, and it means that we can create two identical (generally symmetrical) playing surfaces for each team (or purposely choose different surfaces). Lastly, we have created field designs which can be reproduced, which allows us to standardize the associated rules of the game.

The game therefore becomes more technical, fast and sportive. The greater mobility entailed by this invention renders the sport more spectacular.

The transportable field allows spectators and media greater and easier access during a game.

Another advantage of the invention is the possibility to install a field temporarily for tournaments or events, for instance in an existing sport center. This same field can be used in several places, according to the demand, thus saving money.

Technically, the obstacles are easy to move and the field can be modified to the taste of the users in a few minutes.

Being light and not very bulky (typically around 10 kg), the field is easily transportable in a car.

By using the same system; junction points for the circulation of air, newly shaped obstacles can be introduced regularly while conserving the use of the existing elements.

The use of pressurized (or ventilated) structures offers the players greater security when compared to the traditional natural obstacles; when a player hits an inflatable structure, even at full speed, he will not hurt himself.

The field can be, because of its inflated plastic element structure, installed easily on any surface such as sand, snow, concrete, grass etc. The field remains easy to mantle and dismantle, at temperatures ranging from −40 to +70 citigrade degrees.

The delimitation of the playing field by lateral shafts avoids having to use tape or markings, which would progressively deteriorate.

A variant of the playing field is the production of the elements in a textile similar to the one used for hand-gliding sails, which is hardy and very light at the same time (50 $g/m^2$). The production technique remains similar. Any textile whose surface mass ranges from 50 to 200 $g/m^2$ is adaptable to the production of a playing field such as this one. The maximum limit is determined by the total weight of the field, which should preferably remain light to facilitate transport. The minimum limit is determined by the textile's resistance (internal leg pressure, links etc.) and therefore by the material's technical feasibility.

Spiral zips involving only slightly more than one loop are employable as a variant, and are able to reduce air loss, as are conceivable triple spiral zips to significantly reduce strain on each closing point. The principle of production and use remains unchanged.

Of course, the present invention is not restricted to the details of the forms of production described here as examples, but on the contrary extends to modifications at the hands of the inventor.

The foregoing disclosure has been set forth merely to illustrate the invention and is not intended to be limiting. since modifications of the disclosed embodiments incorporating the spirit and substance of the invention may occur to persons skilled in the art, the invention should be construed to include everything within the scope of the appended claims and equivalents thereof.

What is claimed is:

1. A paint-ball playing field, wherein empty envelope elements are fastened together, creating a continuous interior volume filled with air, under a predetermined pressure of approximately 1.5 bars, and means for compensating losses of said pressure.

2. The playing field according to claim 1, wherein the elements include juxtaposed shafts carrying means for supplying obturable air, on at least one of their sides and at least one of their extremities.

3. The playing field, according to claim 1, further comprising:

large shafts defining the limits of the playing field;

small shafts designed to be perpendicularly fixed on to the large shafts on their obturable air supplying means;

extensions designed to be perpendicularly fixed on to the small shafts on their obturable air supplying means; and obstacles designed to be fixed on to the ends of the extensions or directly on to the small shafts.

4.The playing field according to claim 3, wherein the elements have connection links between the large and small shafts, simple angle elements, and at least one motorized angle element.

5. The paint-ball field according to claim 1, wherein the elements are produced in a porous textile whose weight ranges from 50 to 200 $g/m^2$.

6. The playing field according to claim 5, wherein the field has a textile which is a nylon polyester covered with a layer of polyurethane on the surface.

7. The playing field according to claim 1, wherein the elements are made out of predetermined shapes of material, sewn together.

8. The playing field according to claim 1, wherein the elements have ground fixation keepers, stitched to the elements, and a tarpaulin reinforcement joined to the material by double stitching.

9. The playing field according to claim 1, further comprising link elements including a spiral zip with more than one loop.

10. The playing field according to claim 1, wherein the means for compensating the interior loss of pressure is a centrifugal ventilator of a debit between 0 and ½ $m^3$ per second, adapted to maintain a pressure of approximately 1.5 bars in the interior volume.

* * * * *